US012352522B2

(12) United States Patent
Hansen

(10) Patent No.: US 12,352,522 B2
(45) Date of Patent: Jul. 8, 2025

(54) AIR GUN WITH MIXED GAS CHARGE

(71) Applicant: Crosman Corporation, Bloomfield, NY (US)

(72) Inventor: Jeffrey D. Hansen, Honeoye Falls, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 18/321,499

(22) Filed: May 22, 2023

(65) Prior Publication Data

US 2024/0393080 A1 Nov. 28, 2024

(51) Int. Cl.
*F41B 11/62* (2013.01)
*F41B 11/71* (2013.01)
*F41B 11/723* (2013.01)

(52) U.S. Cl.
CPC ..... *F41B 11/62* (2013.01); *F41B 11/71* (2013.01); *F41B 11/723* (2013.01)

(58) Field of Classification Search
CPC ..... F41B 11/72; F41B 11/73; F41B 11/721; F41B 11/723; F41B 11/62; F41B 11/57; F41B 11/71; F41B 11/642; F41A 17/82
USPC ..... 124/73–77
See application file for complete search history.

(56) References Cited

U.S. PATENT DOCUMENTS

| | | | | |
|---|---|---|---|---|
| 5,368,007 | A * | 11/1994 | Carroll | F17C 7/04 96/208 |
| 7,086,393 | B1 | 8/2006 | Moss | |
| 7,237,545 | B2 * | 7/2007 | Masse | F41B 11/71 124/75 |
| 7,886,731 | B2 * | 2/2011 | Masse | F41B 11/721 124/73 |
| 8,015,907 | B2 * | 9/2011 | Tippmann, Sr. | F41B 11/721 89/7 |
| 8,322,329 | B1 * | 12/2012 | Sikes | F41B 11/723 124/73 |
| 8,579,209 | B1 | 11/2013 | Grubelich et al. | |
| 9,982,962 | B2 | 5/2018 | Kras et al. | |
| 10,337,824 | B2 | 7/2019 | Malheiros et al. | |
| 11,112,207 | B2 * | 9/2021 | Malheiros | F41B 11/723 |
| 11,268,783 | B2 * | 3/2022 | Malheiros | F41B 11/68 |
| 2013/0192577 | A1 | 8/2013 | Maeda | |
| 2020/0025511 | A1 | 1/2020 | Cherry et al. | |

OTHER PUBLICATIONS

Search Report and Written Opinion for International Application No. PCT/US2024/030420, Dated Aug. 13, 2024, 12 pages.

* cited by examiner

*Primary Examiner* — Michael D David
(74) *Attorney, Agent, or Firm* — Lee & Hayes, P.C.

(57) ABSTRACT

An air gun includes a first reservoir storing a first compressed gas, e.g., compressed air, and a second reservoir storing a second compressed gas different from the first compressed gas, e.g., helium. A mixed gas system mixes a supply of the first compressed gas and a supply of the second compressed gas as a gaseous mixture. A firing valve is selectively actuated to release the gaseous mixture to a barrel of the air gun, to fire the air gun.

20 Claims, 5 Drawing Sheets

AIR GUN WITH MIXED GAS CHARGE

BACKGROUND

Air guns are used for a variety of recreational purposes. A specific type of air gun is a pre-charged or pre-charge pneumatic (PCP) air gun. In one type of these air guns, a gas charge is pre-packaged and selectively attached to the air gun. At each firing, some amount of the gas charge is expelled to fire a projectile through a barrel, muzzle, or the like. For example, some PCP air guns are configured to receive a container or cartridge with the gas charge, e.g., as liquid carbon dioxide, to power the air gun. The gas charge diminishes with each shot of the air gun, until the container/cartridge is removed and replaced with a new, fully charged container/cartridge. Other types of PCP air guns include an on-gun reservoir for containing a high-pressure gas charge, e.g., as compressed air. In these types of air guns, the gas charge also diminishes with each shot of the air gun, but instead of removing and replacing the reservoir, the reservoir is re-filled, e.g., using a high pressure storage source.

PCP air guns may be desirable at least because the replaceable container/cartridge and the on-board reservoir are sized to facilitate multiple shots with a single charge. Accordingly, a user may be relieved of manually cocking the air gun after each shot, e.g., as in a break barrel or pump-type air gun. However, while PCP air guns may allow for multiple shots, each shot results in a reduction in pressure of the gas charge. Thus, each subsequent shot has a lower pressure than the previous shot. Practically, this reduced pressure may result in a lower exit velocity of fired projectiles and/or diminished accuracy of the air gun. There is a need in the art for an improved pre-charged pneumatic-type air gun.

BRIEF DESCRIPTION OF THE DRAWINGS

The detailed description is described with reference to the accompanying figures. In the figures, the left-most digit of a reference number identifies the figure in which the reference number first appears. The same reference numbers in different figures indicate similar or identical items.

DETAILED DESCRIPTION

Figure 1:
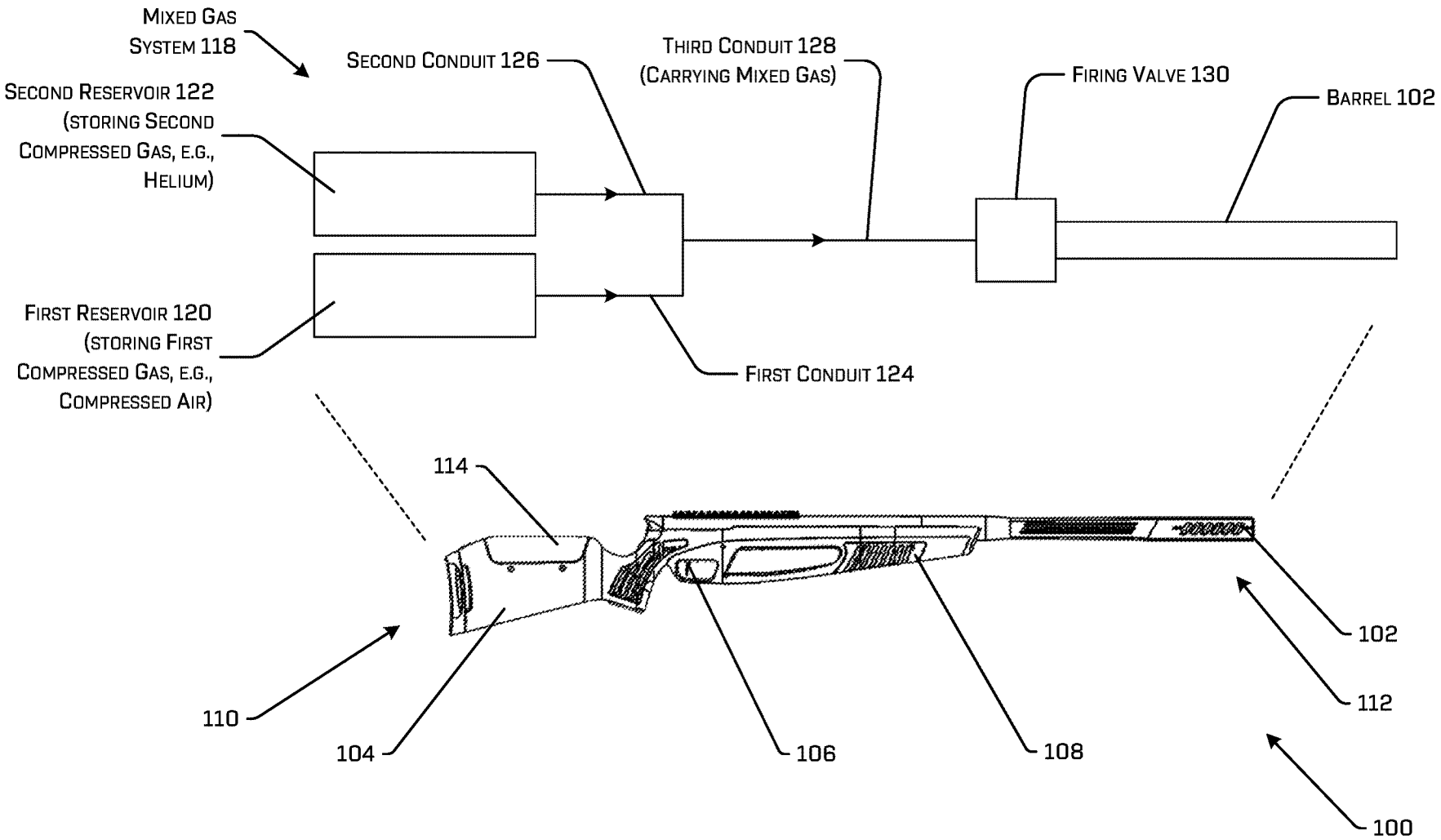
FIG. 1 includes a side view of an example air gun and a schematic representation of a mixed gas supply system according to example implementations of this disclosure.

FIG. 1 illustrates an example air gun 100 according to aspects of this disclosure. More specifically, FIG. 1 is a side exterior view of one implementation of the air gun 100, which includes features for mixed gas firing. FIG. 1 illustrates the air gun 100 as generally including a barrel 102, a stock 104, and a trigger 106. The air gun 100 also includes a housing 108 extending generally between the barrel 102 and the stock 104. The stock 104 and/or the housing 108 may retain and/or conceal components of the air gun 100, as detailed further herein. Without limitation, aspects of this disclosure include components for firing of the air gun 100 with a mix of two or more gasses disposed contained in corresponding reservoirs carried on the air gun 100, and which may be disposed in, attached to, or otherwise associated with the stock 104, the housing 108, and/or other components of the air gun 100.

The barrel 102 extends generally from a breech end 110 to a muzzle end 112. Although not illustrated in FIG. 1, a bore extends through the barrel 102, from the breech end 110 to the muzzle end 112. The bore provides a hollow interior space within the barrel 102 through which compressed gas and a projectile, such as a pellet, can pass, as will be described in greater detail below. The barrel 102 is sufficiently strong to contain high pressure gasses introduced into the barrel 102 to fire the projectile. In implementations, the bore may be smooth, or the bore may be rifled, e.g., to impart a stabilizing spin on the projectile as it passes through the bore.

The trigger 106 may be any lever, button, or the like, configured for user interaction to fire the air gun 100. As detailed further herein, in some instances the trigger 106 is a part of a trigger assembly that, among other features, prevents unintended firing of the air gun 100. For example, and without limitation, the trigger assembly may prevent firing of the air gun 100 while compressed gas is being mixed in the air gun 100, e.g., after firing a projectile.

The stock 104 may be any conventional size or shape. In some instances, the stock 104 may be removably secured to the housing 108, e.g. to promote removal and/or replacement of the stock 104. Moreover, and as discussed below, removal of the stock 104 may facilitate access to an interior of the housing 108, e.g., to service working components of the air gun 100. For instance, removal of the stock 104 may provide access to one or more reservoirs, e.g., in the stock 104 and/or in the housing 108, for refilling and/or replacement. Although not illustrated in FIG. 1, a portion of the housing 108 may include rails extending generally longitudinally, and the stock 104 can be configured with receptacles that engage and slide along the rails. Without limitations, the housing 108 may be extruded and the rails may be a portion of the extrusion, although in other instances the rails may be separately manufactured and secured to the housing 108. In still further examples, the stock may include one or more rails that cooperate with one or more receptacles on the housing 108. The use of rails may reduce the number of fasteners required to secure the stock 104 to the housing 108 and/or may provide a more pleasing aesthetic.

In the example of FIG. 1, the stock 104 includes a removable portion 114. The removable portion 114 may be removable to expose a hollow compartment or receptacle in which components of the air gun 100 may be stored. For example, and without limitation, one or more reservoirs storing compressed gasses may be retained in the stock 104, e.g., for mixing in accordance with aspects of this disclosure. In other examples, one or more power sources (not shown) for powering components, such as a battery or the like, may be disposed in the stock. Although the removable portion 114 is shown as a check portion of the stock 104, in other examples, the removable portion 114 can be formed at a butt end of the stock 104, e.g., as a portion of a recoil pad 116, or the like. Moreover, although the removable portion 114 is described as being removable, in other implementations the removable portion 114 may be movable relative to the air gun 100, e.g., without being removed. For instance, the removable portion 114 may be formed as a hinged cover or the like, e.g., that is movable relative to the stock 104 to allow access to a receptacle or other void in the air gun 100.

The housing 108 is generally provided to contain components of the air gun 100. For instance, and as detailed further below, the housing 108 may contain, support, and/or conceal aspects that facilitate mixed gas firing and/or action of the air gun 100. The shape and size of the housing 108 in FIG. 1 is for illustration. Other shapes, sizes, and compositions are contemplated. Components of the housing may be made of any conventional materials, including but not limited to, metal, such as aluminum, or polymers.

FIG. 1 also includes a schematic representation of a mixed gas system 118 for firing the air gun 100. Specifically, FIG. 1 illustrates a first reservoir 120 and a second reservoir 122. The first reservoir 120 contains a first compressed gas and the second reservoir 122 contains a second compressed gas. In one non-limiting example, the first compressed gas and the second compressed gas may have different flow rates, e.g., through the same orifice. For instance, the first compressed gas may be compressed air, and the second compressed gas may be helium or some other gas that has a lower molecular weight and/or a higher flow rate than compressed air, as detailed further herein.

In the mixed gas system 118, a first conduit 124 carries a first supply of the first compressed gas from the first reservoir 120, and a second conduit 126 carries a second supply of the second compressed gas from the second reservoir 122. As also illustrated schematically, the supply of the first compressed gas, e.g., in the first conduit 124, and the supply of the second compressed gas, e.g., in the second conduit 126, are mixed to form a mixed gas, e.g., flowing through a third conduit 128.

In the mixed gas system 118, the mixed gas is provided to a firing valve 130. For example, the firing valve 130 may be in fluid communication with the third conduit 128, e.g., to receive the mixed gas supply. The firing valve 130 also is illustrated as being in fluid communication with the barrel 102. Specifically, the firing valve 130 may be selectively actuated, e.g., opened, such as in response to actuation of the trigger 106, to allow the mixed gas to exit the air gun 100 via the barrel 102. As in conventional air guns, the compressed air released by the firing valve 130 escapes through the barrel 102, causing a projectile to be fired from the air gun 100, via the barrel 102. However, by using a mix of multiple gasses, aspects of this disclosure can provide an air gun with varied characteristics. For example, in some implementations, mixing a lower molecular weight gas, like helium, with compressed air, can result in a higher speed of the projectile, e.g., compared to firing with only compressed air. Moreover, as is conventionally known, compressed air contained in a reservoir, like the first reservoir 120, will reduce in pressure with each successive discharge, e.g., with each firing of the air gun 100. Using the second compressed gas can act to regulate this pressure loss, e.g., to maintain a more consistent exit velocity over successive shots. For instance, the second compressed gas may be used to "boost" or otherwise increase the efficacy of the first compressed gas as the first reservoir is depleted. In examples described herein, the mixed gas system 118 may be configurable to adjust a mix ratio of the first compressed air and the second compressed air to maintain one or more desired shot characteristics. In other examples, the ratio may be adjustable by the user, e.g., to selectively modify shot characteristics.

In FIG. 1, aspects of the mixed gas system 118 are shown schematically, only for example. Additional details of example implementations of the air gun 100 now will be discussed with reference to additional figures.

Figure 2:
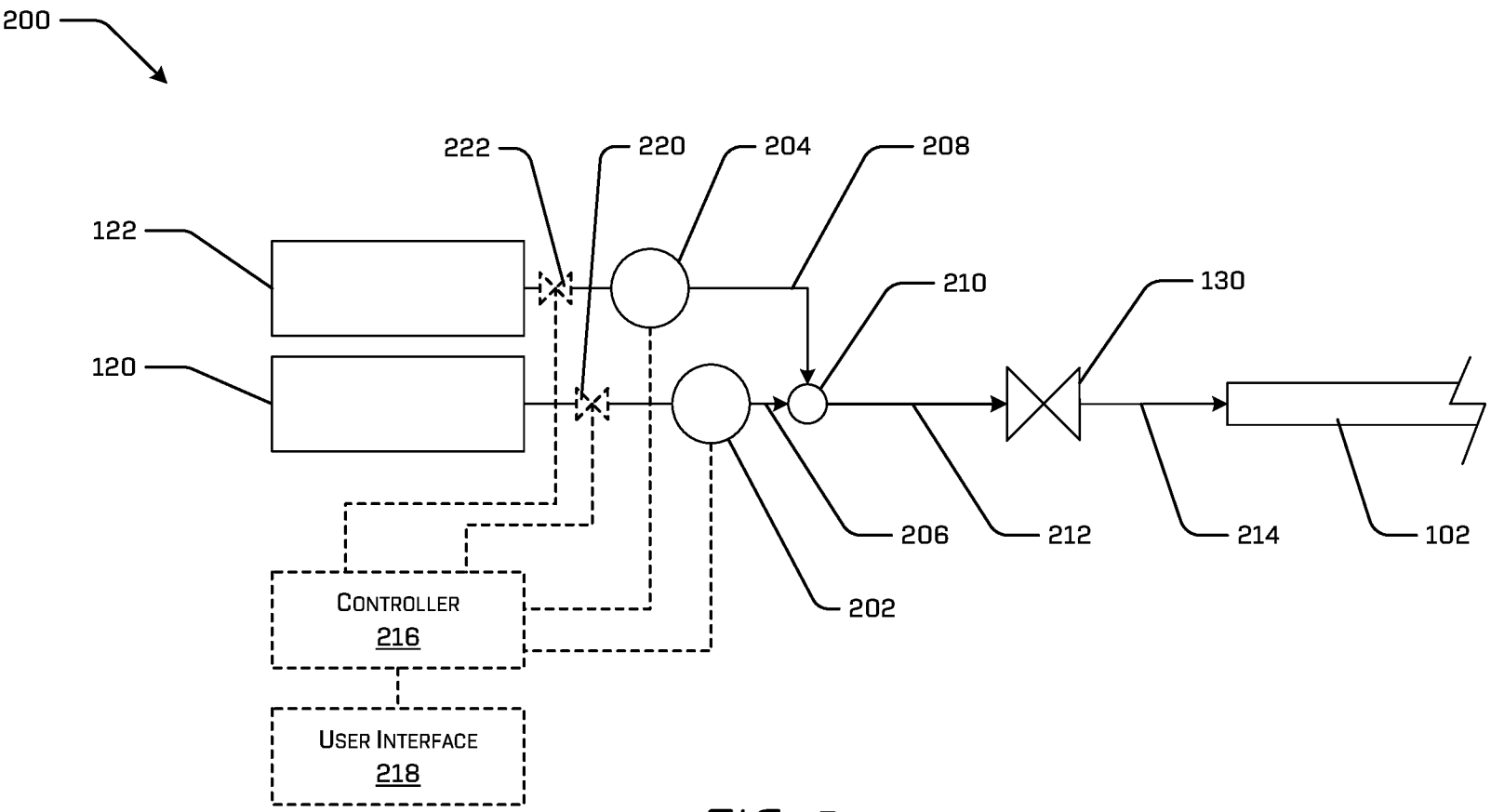
FIG. 2 is a schematic diagram of an air gun with mixed gas, according to example embodiments of the present disclosure.

FIG. 2 is a schematic representation of an example mixed gas system 200. The mixed gas system 200 may be the mixed gas system 118, for example. As with the mixed gas system 118, the mixed gas system 200 includes the first reservoir 120 storing a first compressed gas and the second reservoir storing a second compressed gas. The mixed gas system 200 also includes the firing valve 130 in fluid communication with the first reservoir 120 and the second reservoir 122, as well as in fluid communication with the barrel 102. As with the mixed gas system 118, the first compressed gas and the second compressed gas selectively pass through the firing valve 130, e.g., as a gaseous mixture, and out the barrel 102 to fire the air gun. FIG. 2 also shows additional details of the example mixed gas system 200.

FIG. 2 shows a first metering component 202 and a second metering component 204. The first metering component 202 is associated with the first reservoir 120, e.g., to meter, restrict, regulate, or otherwise control the flow of the first compressed gas from the first reservoir 120. The second metering component 204 is associated with the second reservoir 122, e.g., to meter or otherwise restrict the flow of the second compressed gas from the second reservoir 122. In examples, the first metering component 202 and/or the second metering component 204 may include a fixed flow restrictor. For example, the first metering component 202 and/or the second metering component 204 may comprise a metering orifice, such as an orifice plate or other fixed flow control component. In other examples, the first metering component 202 and/or the second metering component 204 may comprise an adjustable flow control component, such as a metering valve, a pressure regulator, a needle valve, and/or the like. Although illustrated as spaced from the first reservoir 120 and the second reservoir 122, the first metering component 202 and the second metering component 204 may be directly connected to the first reservoir 120 and the second reservoir 122, respectively.

As shown in FIG. 2, the mixed gas system 200 also illustrates a first conduit 206. The first conduit 206 fluidly connects the first reservoir 120 to the firing valve 130. For example, the first conduit 206 may correspond to the first conduit 124. In examples, the first conduit 206 can include one or more hoses, tubes, and/or the like. In some examples, the first conduit 206 may also, or alternatively, include one or more fittings and/or the like. Generally, the first conduit 206 can be any component(s) that fluidly connect(s) the first reservoir 120 and/or the first metering component 202 to the firing valve 130. In some examples, the first conduit 206 may be omitted, e.g., the first reservoir 120 may be connected directly to the firing valve 130, for example via the first metering component 202.

FIG. 2 also shows a second conduit 208. The second conduit 208 is configured to facilitate flow of the second compressed gas from the second reservoir 122 and/or the second metering component 204. In the example of FIG. 2, the second conduit 208 is illustrated, schematically, as fluidly connecting the second metering component 204 to the first conduit 206. In examples, the second conduit 208 may be fluidly connected to the first conduit 206 at a junction 210. For example, the junction 210 may be embodied as any flow control component that allows for the second compressed gas and the first compressed gas to be output as a single, mixed gas. Without limitation, the junction 210 may include a manifold, one or more fittings, one or more valves, and/or the like. In examples, the junction 210 may include one or more components configured to restrict or inhibit "upstream" flow of the first compressed gas and/or of the second compressed gas. Without limitation, a one-way valve or the like may be provided to prevent the second compressed gas from flowing into the first reservoir 120 and/or to prevent the first compressed gas from flowing into the second reservoir 122.

As also illustrated in FIG. 2, downstream of the junction 210, a mixed gas conduit 212 carries the gaseous mixture formed at the junction 210 of the first compressed gas and the second compressed gas. In the illustration, the mixed gas conduit 212 is illustrated as a portion of the first conduit 206. In examples, the mixed gas conduit 212 may comprise the third conduit 128 discussed above.

The mixed gas conduit 212 carries the first compressed gas and the second compressed gas, e.g., as a mixed gas, to the firing valve 130. As described above, the firing valve 130 may be operationally coupled to a trigger, e.g., such that actuation of the trigger causes the firing valve 130 to open, causing the gaseous mixture in the mixed gas conduit to exit via the barrel 102. FIG. 2 also shows a firing conduit 214 fluidly connected to a downstream end, or outlet, of the firing valve 130. The firing conduit 214 may be provided to transfer the gaseous mixture passing through the (open) firing valve 130 to the barrel.

In an example operation, the mixed gas system 200 facilitates creation of a gaseous mixture of a first compressed gas, stored in a first reservoir 120, e.g., a first on-air gun reservoir, and a second compressed gas, stored in a second reservoir 122, e.g., a second on-air gun reservoir, with the gaseous mixture being used to fire a projectile from the air gun including the mixed gas system 200. In more detail, in one example, the firing valve 130 may be operationally coupled to a trigger, such that when the trigger is pulled, the firing valve 130 opens. Opening of the firing valve 130, e.g., by pulling the trigger, allows the air behind, e.g., upstream of, the firing valve 130, to pass through the firing valve 130, the firing conduit 214, and out the barrel 102. More specifically, upon opening of the firing valve, a supply of the first compressed gas passes, from the first reservoir 120, through the first metering component 202, and a supply of the second compressed gas passes, from the second reservoir 122, through the second metering component 204. The gasses then meet (and mix) at the junction 210, with the gaseous mixture continuing to escape through the firing valve 130 until the firing valve is closed. In examples, the firing valve 130 may be mechanically closed, e.g., via a return spring or the like, against the force of the gaseous mixture in the mixed gas conduit 212.

In the foregoing example, the ratio of the first compressed gas to the second compressed gas in the gaseous mix may be determined based at least in part on aspects of the compressed gasses and/or the metering components 202, 204. For instance, and as noted above, the metering components 202, 204 may include a metering orifice, e.g., an orifice plate or metering nozzle, having a predetermined diameter, profile, and/or other characteristic(s). For example, the first metering component 202 may have a relatively larger orifice than the second metering component 204, to provide a greater ratio of the first compressed gas to the second compressed gas. As will be appreciated, when the second compressed gas has a lower molecular weight than the first compressed gas, the second compressed gas may flow more quickly than the first compressed gas through a same-sized orifice. Thus, the second metering component 204 may have a significantly smaller orifice through which the second compressed gas is to flow when the gaseous mix is to include more of the first compressed gas. In some examples, aspects of the metering components 202, 204 may be removable or replaceable. For example, and without limitation, aspects of the metering components may be removed and/or replaced to provide different flow characteristics through the metering components 202, 204. In one example, a metering nozzle or an orifice plate in one or both of the first metering component 202 and/or the second metering component 204 may be replaced with a metering nozzle/orifice plate imparting different flow characteristics, e.g., to vary the ratio of the two compressed gasses in the gaseous mix.

In the example just described the first metering component 202 and the second metering component 204 may have fixed flow characteristics, e.g., from a fixed, static orifice. In additional examples, the first metering component 202 and/or the second metering component 204 may be adjustable. For example, adjusting the metering components 202, 204 may adjust the ratio of the compressed gasses in the gaseous mix. In examples, the first metering component 202 and/or the second metering component 204 can include a metering valve or the like, which can be adjusted, e.g., by a user via a user interface such as a dial, a lever, or the like, to adjust the amount of the first compressed gas and/or the second compressed gas that flows through the barrel with each actuation of the firing valve.

In some examples, the metering components 202, 204 may be manually actuated, e.g., by manually adjusting a user interface. In examples, the user interface may be accessible during use of the gun, e.g., to allow a user to adjust between shots or otherwise on demand. For instance the user interface may be accessible on an exterior of the housing. In other examples, the user interface may be inaccessible during use of the air gun. For instance, the user interface may be accessible only upon removal of a portion of the housing, or the like. In these examples, the metering components 202, 204 may be accessed at the time of refilling the first reservoir 120 and/or the second reservoir 122, at the time of assembly of the air gun, or the like. In still further examples, the metering components 202, 204 may be adjusted via one or more tools.

In other examples, one or both of the first metering component 202 and/or the second metering component 204 may be adjusted using one or more electrical and/or electromechanical components. For example, FIG. 2 shows an optional controller 216 operably coupled to the first metering component 202 and to the second metering component 204. In this example, the controller 216 may be configured to generate and transmit signals to the first metering component 202 and/or the second metering component 204, e.g., to cause the metering components 202, 204 to alter a configuration associated with flow through those components. In one non-limiting example, the controller 216 may be programmed to alter the metering components 202, 204 automatically, e.g., according to a predetermined setting or series of settings. For instance, the controller 216 may be configured to adjust the metering components 202, 204 to alter the ratio of the gaseous mixture to maintain a relatively constant exit velocity for projectiles. As noted herein, in conventional applications compressed air loses pressure as an air gun is fired. Aspects of this disclosure can facilitate increasing an amount of the second compressed gas in a gaseous mix to offset the loss in power resulting from repeated discharges. Although not illustrated, the controller 216 can also receive information about aspects of the air gun, and determine an appropriate ratio based at least in part on these aspects. Without limitation, the controller may be configured to alter settings of the metering components 202 based at least in part on the air gun being fired, a number of shots taken with the air gun, a duration since the reservoirs were refilled, and/or other aspects that may influence a current state of (charge of) the air gun.

The controller 216 may also, or alternatively, include functionality to determine, e.g., in real time, a mix ratio for the first and second compressed gasses, and cause the metering components 202, 204 to be configured in accordance with the determined ratio. In one non-limiting example, the controller 216 can receive pressure information about the first reservoir 120 and/or the second reservoir 122, e.g., from a pressure gauge or the like (not shown), and determine an appropriate mix ratio for firing the air gun based at least in part on the pressure information. For example, and without limitation, the controller 216 can determine a first mix ratio when the first reservoir is pressurized to 4500 psi and a second, different mix ratio when the first reservoir is pressurized to 2500 psi. For instance, the ratio of the first compressed gas to the second compressed gas may be relatively higher when the first reservoir has a relatively higher pressure, and the ratio may be relatively lower when the first reservoir 120 has a relatively lower pressure. In some examples, the mix ratios may be determined as a function of the pressure of the first reservoir 120 and/or the second reservoir empirically, and stored in a memory accessible by or otherwise associated with the controller 216. The controller 216 may also access or have an associated memory storing information about configurations of the metering components 202, 204 to achieve the desired mix ratios. In examples, settings for the metering components 202, 204 to achieve the desired mix ratio may be based at least in part on a type of the metering component(s) 202, 204, a pressure in the first reservoir 120 and/or the second reservoir 122, and/or other factors.

In examples just described the controller 216, when included, may be programmed, e.g., preprogrammed, to adjust aspects of the metering components 202, 204 to control a mix ratio based on an expected state (e.g., based on a number of firings) or a measured state (e.g., based on a measured pressure in one or both of the reservoirs 120, 122) of the air gun. In still further examples, the controller 216 may additionally or alternatively include functionality to configure the metering components 202, 204 to adjust the mix ratio based on one or more user inputs or preferences. FIG. 2 illustrates an optional user interface 218 in communication with the associated with the controller 216. For example, the user interface 218 may include one or more manipulable user controls, e.g., as switches, dials, touch inputs, or the like, to adjust aspects of the first metering component 202 and/or the second metering component 204. In examples, the user interface 218 may allow a user to select a ratio of the first compressed gas to the second compressed gas, a desired muzzle velocity, or the like, and the controller may generate and transmit signals to cause the metering components 202, 204 to effectuate the desired characteristic.

The user interface 218 may also include a display for providing information to the user about aspects of the air gun. For example, the user interface 218 may provide a visual output associated with a mix ratio, a muzzle velocity, or the like. For instance, the visual output may provide feedback as adjustments are made by the user.

The controller 216, when provided, may perform additional, or different, functionality. For example, FIG. 2 also illustrates a first valve 220 associated with the first reservoir 120 and a second valve 222 associated with the second reservoir 122. The controller 216 is coupled to the first valve 220 and the second valve 222, e.g., to selectively control opening and closing of the valves 220, 222. In at least some examples, the controller 216 can control the first valve 220 and/or the second valve 222 to facilitate further control of flow from the first reservoir 120 and/or the second reservoir 122, respectively. In one non-limiting example, the controller 216 can control the second valve 222 to delay a release of the second compressed gas from the second reservoir, e.g., relative to a release of the first compressed gas. In this example, prior to actuation of a trigger to open the firing valve 130, the first valve 220 may be open (or nonexistent) and the second valve 222 may be closed. When the trigger is actuated, the firing valve 130 opens, allowing a supply of the first compressed gas to escape from the barrel 102, e.g. via the firing valve 130 as described above. The controller 216 is configured to then, with the firing valve 130 already open, cause the second valve 222 to open, to allow the second compressed gas to exit the mixed gas system 200 via the (still) open firing valve 130. Thus, a first portion of the fired gas may include substantially only the first compressed gas and a second portion (fired after the first portion) may be mixed. In one non-limiting example, when the first compressed gas is pressurized air and the second gas is helium, the example just described may result in a delayed release of the helium, which could allow the helium, which expands more quickly than air, to act as a "catch up gas," e.g., to fill in behind the projectile in the barrel 102, to maintain an elevated pressure in the barrel for a longer period of time. In still other examples, the first valve 220 may be closed after firing, e.g., to stop a continued flow of the first compressed gas through the firing valve. Thus, in some aspects of this disclosure, a mix ratio of the gasses may vary during a firing cycle.

In a still further implementation, the controller 216 can be configured to implement a serial release of the two compressed gasses. For example, in another non-limiting example, prior to actuation of a trigger to open the firing valve 130, the first valve 220 may be open and the second valve 222 may be closed. When the trigger is actuated, the firing valve 130 opens, allowing a supply of the first compressed gas to escape from the barrel 102, e.g. via the firing valve 130 as described above. The controller 216 is configured to then, with the firing valve 130 already open, cause the first valve 220 to close and cause the second valve 222 to open. Accordingly, flow of the first compressed gas is stopped while the second compressed gas is allowed to exit the mixed gas system 200 via the (still) open firing valve 130. Thus, a first portion of the fired gas may include only the first compressed gas and a second portion (fired after the first portion) may be only the second compressed gas. In one non-limiting example, when the first compressed gas is pressurized air and the second gas is helium, the example just described may result in a delayed release of the helium, which could allow the helium, which expands more quickly than air, to act as a "catch up gas," e.g., to fill in behind the projectile in the barrel 102, to maintain an elevated pressure in the barrel for a longer period of time. In this example, the second compressed gas may be substantially separate from, e.g., after, the first compressed gas, or the second compressed gas may at least partially "mix" with the first compressed gas, e.g., as the second compressed gas passes through the gun at a faster rate.

As will be appreciated, the arrangement of FIG. 2 is for example only. Modifications are contemplated. For example, although the mixed gas conduit 212 is illustrated as extending from the junction 210 to the firing valve 130, in other implementations the firing valve 130 can perform functions associated with the junction. For example, the firing valve 130 may include two inlets, e.g., a first for the first compressed gas and the second for the second compressed gas, and a single outlet, e.g., such that the gasses are mixed at or proximate the firing valve 130. Stated differently, the mixed gas conduit 212 may be omitted in some instances. Moreover, although FIG. 2 shows the firing conduit 214, in other examples the firing valve 130 may be disposed proximate the barrel 102, which may obviate the need for the firing conduit 214. As will be appreciated by those having ordinary skill in the art, with the benefit of this disclosure, aspects of this disclosure may be obtained using a number of flow control components and/or arrangements of components.

Figure 3:
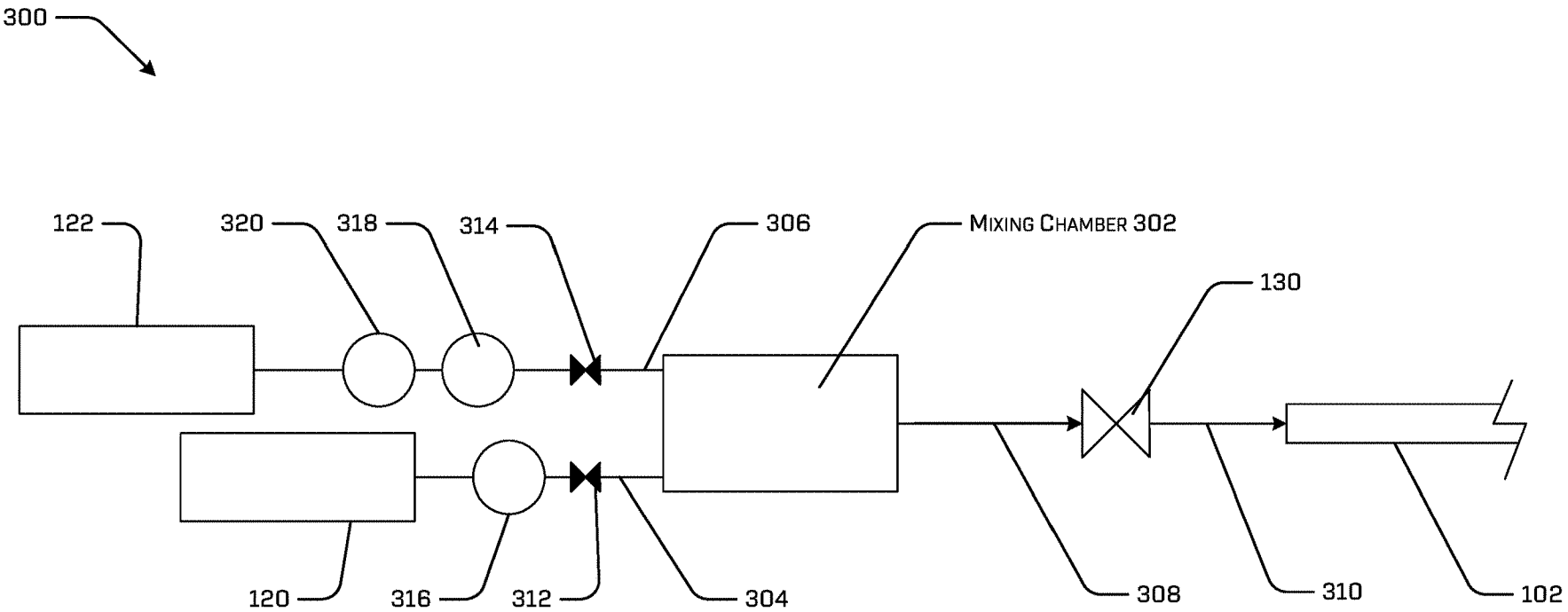
FIG. 3 is a schematic diagram of an air gun with mixed gas, according to additional example embodiments of the present disclosure.

FIG. 3 is a schematic representation of another example mixed gas system 300. The mixed gas system 300 may be the mixed gas system 118, for example. As with the mixed gas system 118 (and the mixed gas system 200), the mixed gas system 300 includes the first reservoir 120 storing a first compressed gas and the second reservoir storing a second compressed gas. The mixed gas system 200 also includes the firing valve 130 in fluid communication with the first reservoir 120 and the second reservoir 122, as well as in fluid communication with the barrel 102. As with the mixed gas system 118 and the mixed gas system 200, the first compressed gas and the second compressed gas selectively pass through the firing valve 130, e.g., as a gaseous mixture, and out the barrel 102 to fire the air gun. FIG. 3 also shows additional details of the example mixed gas system 300.

The mixed gas system 300 includes a third reservoir 302, which may comprise a mixing chamber or mixing plenum. More specifically, the third reservoir 302 is in fluid communication with the first reservoir 120, via a first conduit 304. The third reservoir 302 also is in fluid communication with the second reservoir 122, via a second conduit 306. In examples, the first conduit 304 and/or the second conduit 306 can include one or more hoses, tubes, and/or the like. In some examples, the first conduit 304 and/or the second conduit 306 may also, or alternatively, include one or more fittings and/or the like. Generally, the first conduit 304 can be any component(s) that fluidly connect(s) the first reservoir 120 to the third reservoir 302, and/or the second conduit 306 can be any component(s) that fluidly connect(s) the second reservoir 122 to the third reservoir 302. In some examples, the first conduit 304 and/or the second conduit 306 may be omitted, e.g., the first reservoir 120 and/or the second reservoir 122 may be connected directly to the third reservoir 302 and/or the connection(s) may be made via one or more other flow control components, as described herein.

In operation, a first supply of the first compressed gas from the first reservoir 120 and a second supply of the second compressed gas from the second reservoir 122 are supplied to the third reservoir 302. In the third reservoir 302, the first supply and the third supply are mixed to form a gaseous mix. As also illustrated in FIG. 3, downstream of the third reservoir 302, a mixed gas conduit 308 carries the gaseous mixture of the first compressed gas and the second compressed gas contained in the mixing chamber 302. In some examples, the mixed gas conduit 308 may comprise the third conduit 128 discussed above.

The mixed gas conduit 308 carries the mixed gas from the third reservoir 302 to the firing valve 130. As described above, the firing valve 130 may be operationally coupled to a trigger, e.g., such that actuation of the trigger causes the firing valve 130 to open, causing the gaseous mixture in the mixed gas conduit to exit via the barrel 102. FIG. 2 also shows a firing conduit 310 fluidly connected to a downstream end, or outlet, of the firing valve 130. The firing conduit 310 may be provided to transfer the gaseous mixture passing through the (open) firing valve 130 to the barrel 102.

In an example operation, the mixed gas system 300 facilitates creation of a gaseous mixture of a first compressed gas, stored in the first reservoir 120, e.g., a first on-air gun reservoir, and a second compressed gas, stored in the second reservoir 122, e.g., a second on-air gun reservoir, with the gaseous mixture being used to fire a projectile from the air gun including the mixed gas system 300. In more detail, in one example, a supply of the first gas and a supply of the second gas are mixed (and stored) in the third reservoir, which is fluidly connected to the firing valve 130. The firing valve 130 may be operationally coupled to a trigger, such that when the trigger is pulled, the firing valve 130 opens. Opening of the firing valve 130, e.g., by pulling the trigger, allows the air stored in the third reservoir 302, e.g., upstream of, the firing valve 130, to pass through the firing valve 130, the firing conduit 310, and out the barrel 102. In examples, the firing valve 130 may be mechanically closed, e.g., via a return spring or the like, after discharge of the mixed gas in the third reservoir 302. In examples, the third reservoir may be sized to contain a predetermined amount of the mixed gas, e.g., determined to fire the air gun in accordance with a desired operation of the air gun.

FIG. 3 also illustrates additional components of the mixed gas system 300. For example, FIG. 3 illustrates a first valve 312 associated with the first conduit 304 and a second valve 314 associated with the second conduit 306. In some examples, the valves 312, 314 may be one-way valves that allow flow of the respective gasses from the first reservoir 120 and the second reservoir 122 to the third reservoir 302, but resist or prevent upstream flow, e.g., of the mixed gas in the third reservoir 302 to the reservoirs 120, 122. In other examples, the first valve 312 and/or the second valve 314 may be controllable, e.g., via a controller like the controller 216 discussed above, to selectively allow or prevent flow therethrough. In at least some examples, the one or more of the first valve 312 and/or the second valve 314 may be controlled to obtain a desired gas mix ratio. In one non-limiting example, when the third reservoir 302 is to be filled, e.g., after a shot has been fired or whenever the air gun is to be prepped for firing, the first valve 312 may be closed, to prevent the flow of the first compressed gas into the third reservoir 302, and the second valve 314 may be opened, to allow a supply of the second compressed gas in the second reservoir 122 to enter the third reservoir 302. For instance, the second valve 314 may be opened to fill the third reservoir to 1000 psi helium. After some time (or a predetermined pressure), the first valve 312 may be opened, to allow a supply of the first compressed gas to flow from the first reservoir 120 and into the third reservoir 302 to mix with the second compressed gas already in the third reservoir, e.g., to a predetermined pressure. Continuing the example in which 1000 psi helium is supplied to the third reservoir 320, the first valve 312 may be opened to allow compressed air to enter the third reservoir 320 to a pressure of 2,500 psi. In examples, the second valve 314 may also be closed, e.g., to prevent continued flow of the second compressed gas into the third reservoir 302. For example, the timing of the opening (and closing) of the valves 312, 314 may be based at least in part on one or more of a flow rate of the compressed gas(ses), a pressure of the first reservoir 120, a pressure of the second reservoir 122, the desired mix ratio, physical attributes of the conduits 304, 306 and/or other flow control components, and/or any other factors that may impact the gaseous mix or formation thereof.

FIG. 3 also illustrates a first metering component 316 and a second metering component 318. The first metering component 316 is associated with the first conduit 304, e.g., to regulate flow through the first conduit 304. The second metering component 318 is associated with the second conduit 306, e.g., to regulate flow through the second conduit 306. In examples, the metering components 316, 318 may correspond to the metering components 202, 204, discussed above in connection with FIG. 2. In at least some examples, the first metering component 316 and/or the second metering component can comprise a flow regulator. In some examples, the flow regulator may be adjustable, e.g., to adjust the ratio of the gaseous mix. Additional and/or different flow control components may also be used in the mixed gas system 300. For example, FIG. 3 also illustrates a flow restrictor 320, associated with the first conduit 304. In examples, the flow restrictor could be used to restrict flow of the first compressed gas, e.g., to allow the second compressed gas to first enter the third reservoir, e.g., as described above in connection with the discussion of the valves 312, 314, above. The flow control components shown in FIG. 3 are for example only. More, fewer, or different components may be provided to generate the mixed gas in the third reservoir 302.

Moreover, aspects of the mixed gas system 200 described above may be included in the mixed gas system 300. For example, and without limitation, the mixed gas system 300 can include a controller, e.g., to control aspects of the flow control components, including, but not limited to, the first valve 312, the second valve 314, the first metering component 316, the second metering component 318, and/or the flow restrictor 320. Moreover, the mixed gas system 300 can include one or more user interfaces for a user to control aspects of the air gun 100. Without limitation, such a user interface may be configured to allow a user to select aspects of the gaseous mix, e.g., to obtain desired shot and/or firing characteristics.

Figure 4:
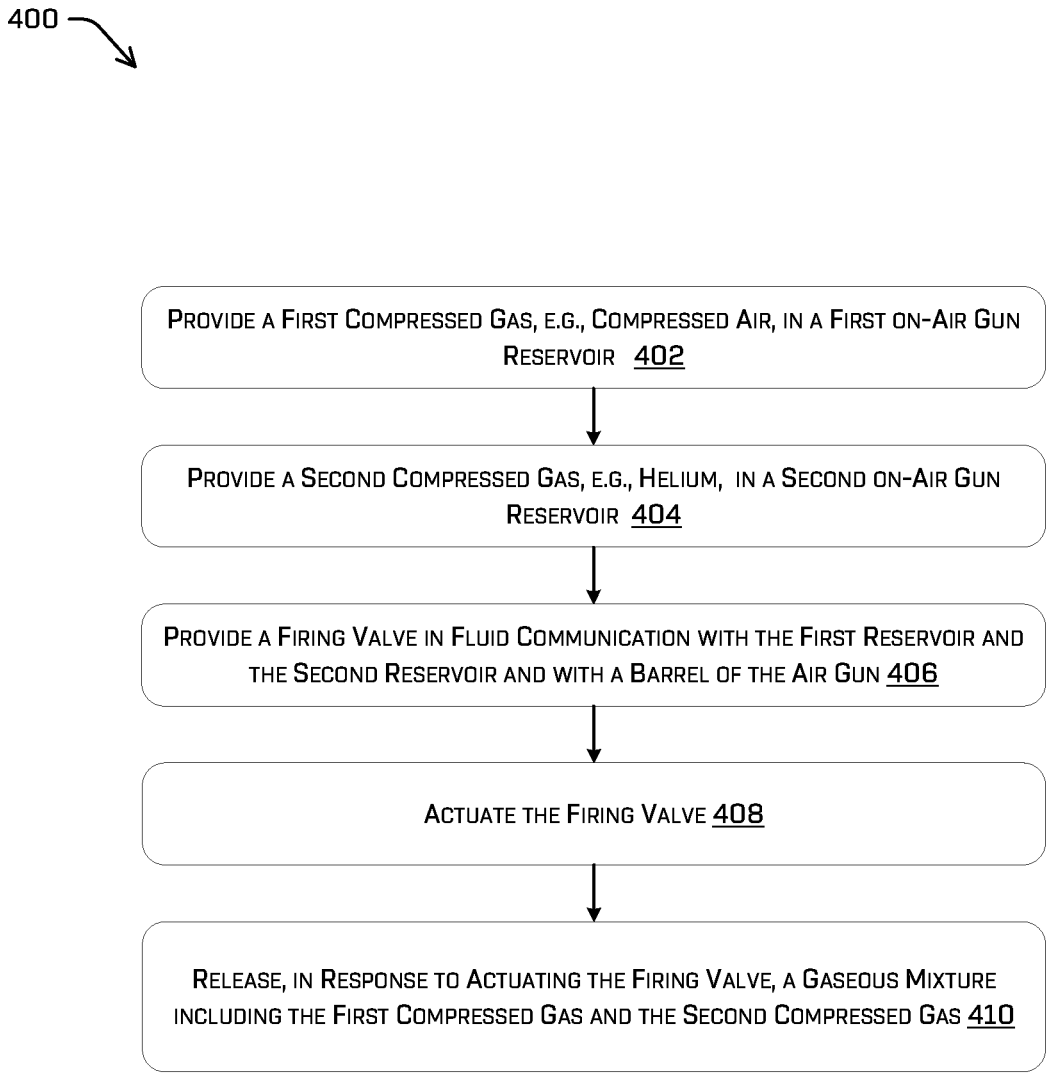
FIG. 4 is a flow chart showing an example process of firing an air gun with mixed gas, according to examples of this disclosure.
Figure 5:
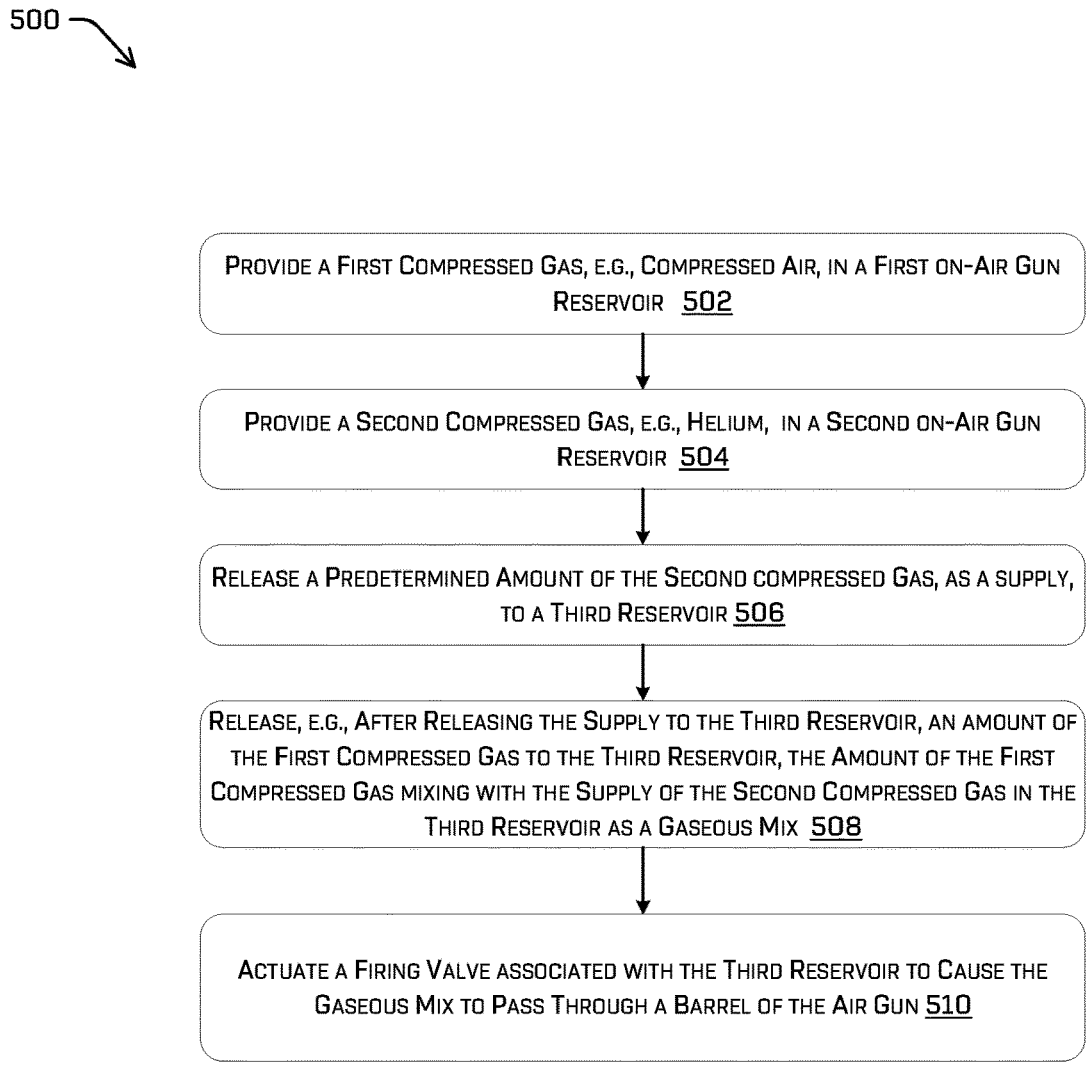
FIG. 5 is a flow chart showing another example process of firing an air gun with mixed gas, according to examples of this disclosure.

The mixed gas systems 118, 200, 300 discussed herein provide improved air gun operation and/or performance and/or increased configurability. FIG. 4 and FIG. 5 illustrate example processes in accordance with embodiments of the disclosure. These processes are illustrated as logical flow graphs, each operation of which represents a sequence of operations that can be implemented in hardware, software, or a combination thereof. In the context of software, the operations represent computer-executable instructions stored on one or more computer-readable storage media, e.g., non-transitory media, that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described operations can be combined in any order and/or in parallel to implement the processes.

It should be appreciated that the subject matter presented herein may be implemented as a computer process, a computer-controlled apparatus, a computing system, or an article of manufacture, such as a computer-readable storage medium. In examples, the air gun 100 can include a control system for implementing aspects the processes 400, 500, as well as other functionality, of the air gun 100. For instance, the control system can include the controller 216, the metering components 202, 204, 316, 318, the valves 220, 222, 312, 314, the firing valve 130, and/or other components. While the subject matter described with respect to the process 400 and the process 500 are presented in the general context of operations that may be executed on and/or with one or more computing devices, those skilled in the art will recognize that other implementations may be performed in combination with various program/controller modules. Generally, such modules include routines, programs, components, data structures, and other types of structures that perform particular tasks or implement particular abstract data types.

Those skilled in the art will also appreciate that aspects of the subject matter described with respect to the process 400 and the process 500 may be practiced on or in conjunction with other computer system configurations beyond those described herein, including multiprocessor systems, microprocessor-based or programmable consumer electronics, minicomputers, mainframe computers, handheld computers, mobile telephone devices, tablet computing devices, special-purposed hardware devices, network appliances, and the like.

In more detail, FIG. 4 is a flow diagram illustrating an example process 400 for operating an air gun with a mixed gas system, as described herein. In some examples, aspects of the process 400 may be performed by the mixed gas system 200 described above.

The example process 400 includes, at an operation 402, providing a first compressed gas in a first on-air gun reservoir. For example, the first reservoir 120 can be charged with a compressed gas, e.g., as compressed air. As noted, the first reservoir 120 is provided on the air gun, and may be recharged or replaced when spent. In example implementations, the first reservoir 120 can be disposed in the housing 108.

At an operation 404, the process 400 includes providing a second compressed gas in a second on-air gun reservoir. For example, the second reservoir 122 can be charged with a compressed gas, e.g., helium or some other gas that has a relatively lower molecular weight, e.g., as compared to the first compressed gas stored in the first reservoir 120. As noted, the second reservoir 122 also is provided on the air gun 100, and may be recharged or replaced when spent. In example implementations, the second reservoir 122 can be disposed in the housing 108.

At an operation 406, the process 400 includes providing a firing valve in fluid communication with the first reservoir and the second reservoir and a barrel of the gun. In the examples discussed above, the firing valve 130 is disposed to be selectively opened, e.g., in response to actuation of the trigger 106. In the example of FIG. 2, the firing valve 130 is configured to receive the gaseous mixture, e.g., via the mixed gas conduit 212, and selectively communicate the gaseous mixture, e.g., via the firing conduit 214, to the barrel 102 to fire a projectile.

At an operation 408, the process 400 includes actuating the firing valve. As noted above, the firing valve 130 may be coupled to the trigger 106, e.g., such that actuation of the trigger 106 causes the firing valve to open.

At an operation 410, the process 400 includes releasing, in response to actuating the firing valve, a gaseous mixture including the first compressed gas and the second compressed gas. In the example of FIG. 2, opening of the firing valve causes a supply of the first compressed gas and a supply of the second compressed gas to pass through the (open) firing valve 130. As detailed above, the first compressed gas and the second compressed gas may be mixed upstream of the firing valve, e.g., at the junction 210, such that the gaseous mixture passes through the open firing valve 130. As also detailed above, a ratio of the mixture may be determined, at least in part, on flow control components, including but not limited to the first metering component 202, the second metering component 204, and/or other components discussed above.

FIG. 5 is a flow diagram illustrating an example process 500 for operating an air gun with a mixed gas system, as described herein. In some examples, aspects of the process 500 may be performed by the mixed gas system 300 described above.

The example process 500 includes, at an operation 502, providing a first compressed gas in a first on-air gun reservoir. For example, the first reservoir 120 can be charged with a compressed gas, e.g., as compressed air. As noted, the first reservoir 120 is provided on the air gun, and may be recharged or replaced when spent. In example implementations, the first reservoir 120 can be disposed in the housing 108.

At an operation 504, the process 500 includes providing a second compressed gas in a second on-air gun reservoir. For example, the second reservoir 122 can be charged with a compressed gas, e.g., helium or some other gas that has a relatively lower molecular weight, e.g., as compared to the first compressed gas stored in the first reservoir 120. As noted, the second reservoir 122 also is provided on the air gun 100, and may be recharged or replaced when spent. In example implementations, the second reservoir 120 can be disposed in the housing 108.

At an operation 506, the process 500 includes releasing a predetermined amount of the second compressed gas, e.g., as a gas supply, to a third reservoir. The operation 506 can include metering an amount of the second compressed gas, e.g., helium, from the second reservoir 122 to a third reservoir, which may be the third reservoir 302 discussed above. In the example of FIG. 3, the third reservoir 302 may be a mixing plenum or mixing chamber.

At an operation 508, the process 500 includes releasing an amount of the first compressed gas to the third reservoir. The operation 508 may be implemented after the operation 506 in some examples. Also in examples, the amount of first compressed gas mixes with the second compressed gas (already) in the third reservoir 302. In examples, by staggering the introduction of gasses to the reservoir, a mix ratio can be better controlled, e.g., by more closely metering the amount of the lower molecular weight gas (such as the helium), before adding compressed air.

At an operation 510, the process 500 includes actuating a firing valve associated with the third reservoir to cause the gaseous mix to pass through a barrel of the gun. As noted above, the firing valve 130 may be coupled to the trigger 106, e.g., such that actuation of the trigger 106 causes the firing valve to open.

The subject matter described above is provided by way of illustration only and should not be construed as limiting. Furthermore, the claimed subject matter is not limited to implementations that solve any or all disadvantages noted in any part of this disclosure. Various modifications and changes may be made to the subject matter described herein without following the examples and applications illustrated and described, and without departing from the spirit and scope of the present invention, which is set forth in the following claims.

I claim:

1. An air gun comprising:

a housing;

a barrel extending from the housing;

a first reservoir coupled to the housing and containing a first compressed gas;

a second reservoir coupled to the housing and containing a second compressed gas different from the first compressed gas; and a fluid transfer system configured to perform operations comprising:

receiving a first supply of the first compressed gas from the first reservoir;

receiving a second supply of the second compressed gas from the second reservoir;

retaining a gaseous mixture including the first supply of the first compressed gas and the second supply of the second compressed gas; and transferring, in response to firing of the air gun, the gaseous mixture including the first supply of the first compressed gas and the second supply of the second compressed gas through the barrel to launch a projectile.

2. The air gun of claim 1, wherein the fluid transfer system comprises a third reservoir configured to retain gaseous mixture including the first supply of the first compressed gas and the second supply of the second compressed gas.

3. The air gun of claim 2, further comprising:

a first valve configured to meter flow of the first supply of the first compressed gas from the first reservoir; or a second valve configured to meter flow of the second supply of the second compressed gas from the second reservoir.

4. The air gun of claim 3, further comprising a regulator associated with the first valve or the second valve.

5. The air gun of claim 4, wherein the regulator is adjustable to modify a ratio of the first compressed gas to the second compressed gas.

6. The air gun of claim 1, wherein the fluid transfer system comprises:

a first conduit for transferring the first supply of the first compressed gas; and a second conduit for transferring the second supply of the second compressed gas, the second conduit converging with the first conduit to provide the second compressed gas to a flow of the first compressed gas through the first conduit.

7. The air gun of claim 1, further comprising:

a first valve configured to control flow of the first supply from the first reservoir;

a second valve configured to control flow of the second supply from the second reservoir; and a controller configured to selectively actuate the first valve and the second valve to control a ratio of a mix including the first supply and the second supply.

8. The air gun of claim 7, further comprising:

a third reservoir configured to receive the first supply of the first compressed gas and the second supply of the second compressed gas, wherein the controller is further configured to perform actions comprising:

causing the first valve to open to allow transfer of the first supply from the first reservoir to the third reservoir;

causing, in response to the transfer of the first supply, the first valve to close;

after causing the first valve to close, causing the second valve to open to allow transfer of the second supply from the second reservoir to the third reservoir; and causing, in response to the transfer of the second supply, the second valve to close.

9. The air gun of claim 8, further comprising:

a one-way valve associated with the third reservoir, the one-way valve configured to allow at least one of the transfer of the first supply to the third reservoir or the transfer of the second supply to the third reservoir and to prevent the first supply or the second supply from the third reservoir.

10. The air gun of claim 7, further comprising:

a user interface configurable by a user to select the ratio of the mix including the first supply and the second supply.

11. An air gun comprising:

a barrel disposed to fire a projectile;

a first reservoir containing a first compressed gas; and a second reservoir containing a second compressed gas, wherein a first supply of the first compressed gas and a second supply of the second compressed gas are mixed to form a gaseous mix, wherein the gaseous mix is retained in the air gun as a retained gaseous mix prior to firing of the air gun, and wherein, in response to firing of the air gun, the retained gaseous mix is provided to the barrel to fire the air gun.

12. The air gun of claim 11, further comprising:

a first metering orifice associated with the first reservoir to control transfer of the first supply of the first compressed gas from the first reservoir; and a second metering orifice associated with the second reservoir to control transfer of the second supply of the second compressed gas from the second reservoir.

13. The air gun of claim 12, further comprising:

a firing valve proximate the barrel and controllable to release the gaseous mix into the barrel.

14. The air gun of claim 13, further comprising:

a trigger, wherein actuation of the trigger causes the firing valve to open.

15. The air gun of claim 11, further comprising:

a third reservoir arranged to receive the first supply of the first compressed gas and the second supply of the second compressed gas, the first supply and the second supply being mixed in the third reservoir to form the gaseous mix.

16. The air gun of claim 11, further comprising:

a first valve configured to control flow of the first supply from the first reservoir; and a second valve configured to control flow of the second supply from the second reservoir.

17. The air gun of claim 16, wherein:

the first valve is a first restrictor; and the second valve is a second restrictor.

18. The air gun of claim 16, further comprising:

a controller configured to selectively actuate the first valve and the second valve to control a ratio of the first compressed gas and the second compressed gas in the gaseous mix.

19. The air gun of claim 18, further comprising:

a third reservoir configured to receive the first supply of the first compressed gas and the second supply of the second compressed gas, wherein the controller is further configured to perform actions comprising:

causing the first valve to open to allow transfer of the first supply from the first reservoir to the third reservoir;

causing, in response to the transfer of the first supply, the first valve to close;

after causing the first valve to close, causing the second valve to open to allow transfer of the second supply from the second reservoir to the third reservoir; and causing, in response to the transfer of the second supply, the second valve to close.

20. The air gun of claim 19, further comprising:

a one-way valve associated with the third reservoir, the one-way valve configured to allow at least one of the transfer of the first supply to the third reservoir or the transfer of the second supply to the third reservoir and to prevent the first supply or the second supply from the third reservoir.

* * * * *